US007810183B2

(12) United States Patent
Kawaguchi et al.

(10) Patent No.: US 7,810,183 B2
(45) Date of Patent: Oct. 12, 2010

(54) BED EQUIPPED WITH SIDE RAILS

(75) Inventors: Jun Kawaguchi, Tokyo (JP); Toru Takada, Tokyo (JP); Jun Tomikawa, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 612 days.

(21) Appl. No.: 11/667,703

(22) PCT Filed: Oct. 31, 2005

(86) PCT No.: PCT/JP2005/019978

§ 371 (c)(1),
(2), (4) Date: Jul. 18, 2007

(87) PCT Pub. No.: WO2006/051705

PCT Pub. Date: May 18, 2006

(65) Prior Publication Data

US 2008/0005836 A1 Jan. 10, 2008

(30) Foreign Application Priority Data

Nov. 15, 2004 (JP) ..... 2004-330740

(51) Int. Cl.
*A47C 21/08* (2006.01)
*A61G 7/05* (2006.01)
*A61G 7/015* (2006.01)

(52) U.S. Cl. ..... 5/425; 5/613

(58) Field of Classification Search ..... 5/425, 5/426–430, 613, 617, 503.1, 658, 662
See application file for complete search history.

(56) References Cited

U.S. PATENT DOCUMENTS 3,097,370 A * 7/1963 Murcott
3,602,929 A * 9/1971 Murcott et al.
3,624,847 A * 12/1971 Murcott ..... 5/429

(Continued)

FOREIGN PATENT DOCUMENTS

JP 8-141020 6/1996

(Continued)

*Primary Examiner*—Robert G Santos
(74) *Attorney, Agent, or Firm*—McGinn IP Law Group PLLC

(57) ABSTRACT

A bed in which a gap between back and leg side-rails is kept constant when a back bottom is raised. A first link and a second link (2, 3) are rotatably supported at lower ends thereof on a frame (1). A coupling (6) is fixed to the base end part of a deck (7), and upper ends of the first and second links (2, 3) are rotatably connected to the coupling (6). An L-shaped rotator (4) is rotatably supported by the frame (1), and one end of a third link (5) is rotatably connected to an upper end (1*c*) of the rotator (4). The other end of the third link (5) is rotatably connected to the coupling (6). An actuator (13) is supported by the frame (1), and a piston rod (13*a*) is rotatably connected to a central portion (1*b*) of the rotator (4). The rotator (4) is turned by an advancing of the piston rod (13*a*); the relative positions of the fourth, fifth, and sixth links are changed; and the leg side-rail slides along the frame (1).

16 Claims, 13 Drawing Sheets

U.S. PATENT DOCUMENTS

| | | | | |
|---|---|---|---|---|
| 4,847,929 | A * | 7/1989 | Pupovic | 5/608 |
| 5,160,010 | A * | 11/1992 | Peterson | 5/613 |
| 5,689,839 | A * | 11/1997 | Laganiere et al. | 5/425 |
| 6,363,552 | B1 * | 4/2002 | Hornbach et al. | 5/425 |
| 6,640,360 | B2 * | 11/2003 | Hornbach et al. | 5/425 |
| 7,028,352 | B2 * | 4/2006 | Kramer et al. | 5/425 |
| 7,100,222 | B2 * | 9/2006 | Metz et al. | 5/430 |
| 7,222,377 | B2 * | 5/2007 | Kramer et al. | 5/425 |
| 7,293,305 | B2 * | 11/2007 | Metz et al. | 5/425 |
| 7,591,034 | B2 * | 9/2009 | Kramer et al. | 5/425 |
| 7,644,457 | B2 * | 1/2010 | Hensley et al. | 5/425 |
| 2005/0050635 | A1 * | 3/2005 | Metz et al. | 5/425 |
| 2007/0151027 | A1 * | 7/2007 | Hensley et al. | 5/430 |
| 2008/0005836 | A1 * | 1/2008 | Kawaguchi et al. | 5/425 |

FOREIGN PATENT DOCUMENTS

| | | |
|---|---|---|
| JP | 2825151 | 9/1998 |
| JP | 2998841 | 11/1999 |
| JP | 2003-527204 | 9/2003 |

* cited by examiner

BED EQUIPPED WITH SIDE RAILS

TECHNICAL FIELD

The present invention relates to a bed for therapeutic or nursing use wherein at least the back bottom tilts, and more specifically relates to a bed equipped with side rails wherein interference between the back side-rail and the leg side-rail during the process of raising the back is prevented.

BACKGROUND ART

Examples of prior art related to a bed equipped with side rails include Japanese Domestic Republication No. 2003-527204 (patent document 1), Japanese Patent No. 2998841 (patent document 2), and Japanese Patent No. 2595474 (patent document 3).

A bed side-rail is disclosed in patent document 1, as shown, e.g., in FIGS. 1 and 2 of same patent document, wherein a back side-rail is raised along a deck that supports the back bottom, or the leg side-rail is moved in the direction separated from the back side-rail and along the longitudinal direction of the bed frame in conjunction with the back bottom raising action, with the object being to substantially stabilize the gap between the back side-rail and leg side-rail when the back bottom is raised.

In addition, a bed equipped with side rails is disclosed in patent document 2, as described in FIG. 1 and paragraph 0007 of same patent document, wherein a fence part 15*a* of a side fence 15 on a side of a back bottom 12*a* and a fence part 17*b* of an inserting-type side fence 17 on a side of a leg bottom 12*d* are provided so as to be separated in the width direction of the bottom, whereby the side rails are kept from producing an interference even if the side fence 15 on the side of the back bottom 12*a* follows the back bottom 12*a*, and the fence part 15*a* is brought to a position overlapping the fence part 17*b* of the inserting-type side fence 17 when the back and knees of the bottom 12 are raised.

Furthermore, a bed equipped with side rails is disclosed in Patent Document 3, as shown in FIG. 3 of same patent document, wherein a side rail on the side of the back bottom is upwardly movable in conjunction with the back bottom raising action, and the leg bottom side-rail is secured in place.

Patent document 1: Japanese Domestic Republication No. 2003-527204

Patent document 2: Japanese Patent No. 2998841

Patent document 3: Japanese Patent No. 2595474

DISCLOSURE OF THE INVENTION

Problem to be Solved by the Invention

However, the following problems occur when the back side-rail is moved in the prior art disclosed in the above-described patent document 1. Specifically, tubes for injecting drugs into the body of a patient, the wiring of medical equipment for evaluating the physical condition of the patient, and other equipment are usually removed via the area surrounding the abovementioned back side-rail. In addition, this back side-rail is used to fasten the tubes, wires, or the like. Therefore, as in the prior art disclosed in patent document 1, when the back side-rail is moved, the removal of these tubes for injecting medicine or medical equipment wires is hindered, or fixed locations shift, and a problem is encountered in that the course of medical treatment is impaired. Another problem is presented in that the patient who is lying on the bed will feel a sense of uneasiness due to the back side-rail moving the area around the upper body.

In the prior art disclosed in patent document 1, when the leg side-rail is moved in the direction of being separated from the back side-rail in order to avoid the interference between the leg side-rail and the back side-rail, the gap between the back side-rail and the leg side-rail opens too widely in the area of the upper dead center of the tilting action of the back bottom, and the risk is presented that an arm or leg of the patient will get caught in the space between the leg side-rail and the back side-rail when the leg side-rail is moved.

In addition, in the prior art disclosed in patent document 2, the back side-rail and leg side-rail are separated in the width direction of the bottom to avoid the interference therebetween. Therefore, a risk is presented that part of the body of the patient will get caught in the portion where the two side rails overlap.

Furthermore, in the prior art disclosed in patent document 3, the back side-rail is made to be moveable; therefore, as with patent document 1 described above, a problem is presented in that the back side-rail moves when tubes for injecting medicine into the body of the patient and the like are removed using the area around the back side-rail of the bed, or when the tubes are fastened using the back side-rail. Complications are thus encountered in administrating drugs in a stable manner. Problems are also presented in that the patient who is lying on the bed will feel a sense of uneasiness due to the back side-rail moving the area around the upper body.

The present invention was developed in view of the foregoing problems, and it is an object of the invention to provide a bed equipped with side rails, wherein, when a back bottom is tilted, it is possible to maintain a gap as evenly as possible between the back side-rail and the leg side-rail; prevent the hazards associated with a portion of the body of a patient being caught between the back side-rail and the leg side-rail; prevent the patient from falling off the bed; and avoid impeding the removal and securing of various treatment tubes and cords without causing discomfort to the patient.

Means for Solving the Problem

A bed equipped with side rails according to the present invention comprises a bed frame; a back bottom; a leg bottom; a first link mechanism for tilting the back bottom with respect to the bed frame; a back side-rail fixed to the back bottom; a leg side-rail that is provided to the leg bottom while being allowed to move in the longitudinal direction of the bed; and a second link mechanism that is connected to the first link mechanism and that moves the leg side-rail in conjunction with the tilting motion of the back bottom; wherein the leg side-rail is moved toward the leg end of the bed by the second link mechanism while the back bottom is raised by the first link, and subsequently returns to the opposite side.

In this case, the first link mechanism preferably comprises a first link having one end rotatably connected to a first position of the bed frame and another end rotatably connected to a second position on the back bottom; a second link, which is shorter than the first link, having one end rotatably connected to a third position that is further toward the leg bottom than the first position on the bed frame, and another end rotatably connected to a fourth position that is further toward the leg bottom than the second position of the back bottom; a rotator having one end rotatably connected to the frame; a third link rotatably connected between the other end of the rotator and the first link, the second link, or the back bottom; and an actuator for turning the rotator in one direction to exert force via the third link on the first link and the second link in the rising direction, and turning the rotator in the opposite direction to exert force via the third link on the first link and second link in the returning direction.

Additionally, in this case, the second link mechanism preferably comprises a fourth link having one end rotatably connected to the first link of the first link mechanism; a fifth link rotatably connected to the second link; and a sixth link having one end rotatably connected to the leg side-rail; wherein one end of the fifth link is rotatably connected to the other end of the fourth link, and the other end of the fifth link is rotatably connected to the other end of the sixth link.

Furthermore, in this case, the first link mechanism and the second link mechanism are preferably held within the bed frame as viewed in a plane.

Still further, in this case, it is preferable that the leg side-rail and back side-rail are rectangularly shaped, and that the gap between the rails is equal at the top end and the bottom end before the back is raised.

EFFECT OF THE INVENTION

According to the bed equipped with side rails of the present invention, the leg side-rail is moved toward the leg end of the bed by the second link mechanism via a process of the back bottom being raised by the first link mechanism, and subsequently returns in the opposite direction. The gap between the back side-rail and leg side-rail is thus not made larger than is necessary, and can be kept narrow even in cases where the back bottom has reached the upper dead center of the tilting operation. Therefore, any concern over a part of the body of the patient being caught between the side rails and the like is eliminated. In addition, by fixing the back side-rail so as not to move along the longitudinal direction of the back bottom, there is no discomfort caused to the patient, and the area around the back side-rail can be used as a removal location for a variety of tubes or for the cords of medical equipment, or the back side-rail can be used as a location for securing tubes and cords. Furthermore, the second link mechanism is associated with the first link mechanism to operate as a single entity in conjunction with the operation of the first link. Therefore, the need for separate actuators is eliminated, and the leg side-rail can be moved smoothly in accordance with the operation of raising the back bottom.

According to the bed equipped with side rails of claim 2 of the present application, the rotator is turned in one direction, and the first and second links are turned in the rising direction via the third link; or the rotator is turned in the opposite direction and the first and second links are turned in the returning direction via the third link. The difference in the lengths of the first and second links can thus be employed to efficiently tilt the back bottom.

In addition, according to the bed equipped with side rails of claim 3 of the present application, the fourth through sixth links of the second link mechanism are rotatably connected in series, the fourth link is rotatably connected to the first link of the first link mechanism, the sixth link is rotatably connected to the leg side-rail, and the fifth link is rotatably connected to the second link of the first link mechanism. Therefore, when the back bottom is raised together with the tilting of the first and second links, the second link mechanism operates in engagement with the first link mechanism, which raises the back bottom, the leg side-rail moves smoothly toward the leg end in the longitudinal direction of the bed frame in conjunction with the raising of the back bottom, and the leg side-rail returns in the reverse direction when the back bottom reaches near the upper dead center of the raising-tilting operation. The gap between the back side-rail and the leg side-rail can thus usually be kept substantially fixed.

According to the bed equipped with side rails of claim 4 of the present application, the first and second link mechanisms are accommodated within the bed frame in a planar fashion. The device as a whole can therefore be made compact.

According to the bed equipped with side rails of claim 5 of the present application, the leg side-rail and back side-rail are rectangular, and the gap therebetween is equal at the top end and the bottom end before the back is raised. The gap between the upper ends of the side rails can thus be made narrower than when the corners of the side rails are arched in shape. It is thus possible to avoid the undesirable event of having a part of the body of the patient caught in the gap between the leg side-rail and the back side-rail when the bed is in a flat state.

DESCRIPTION OF THE REFERENCE NUMERALS

Figure 1:
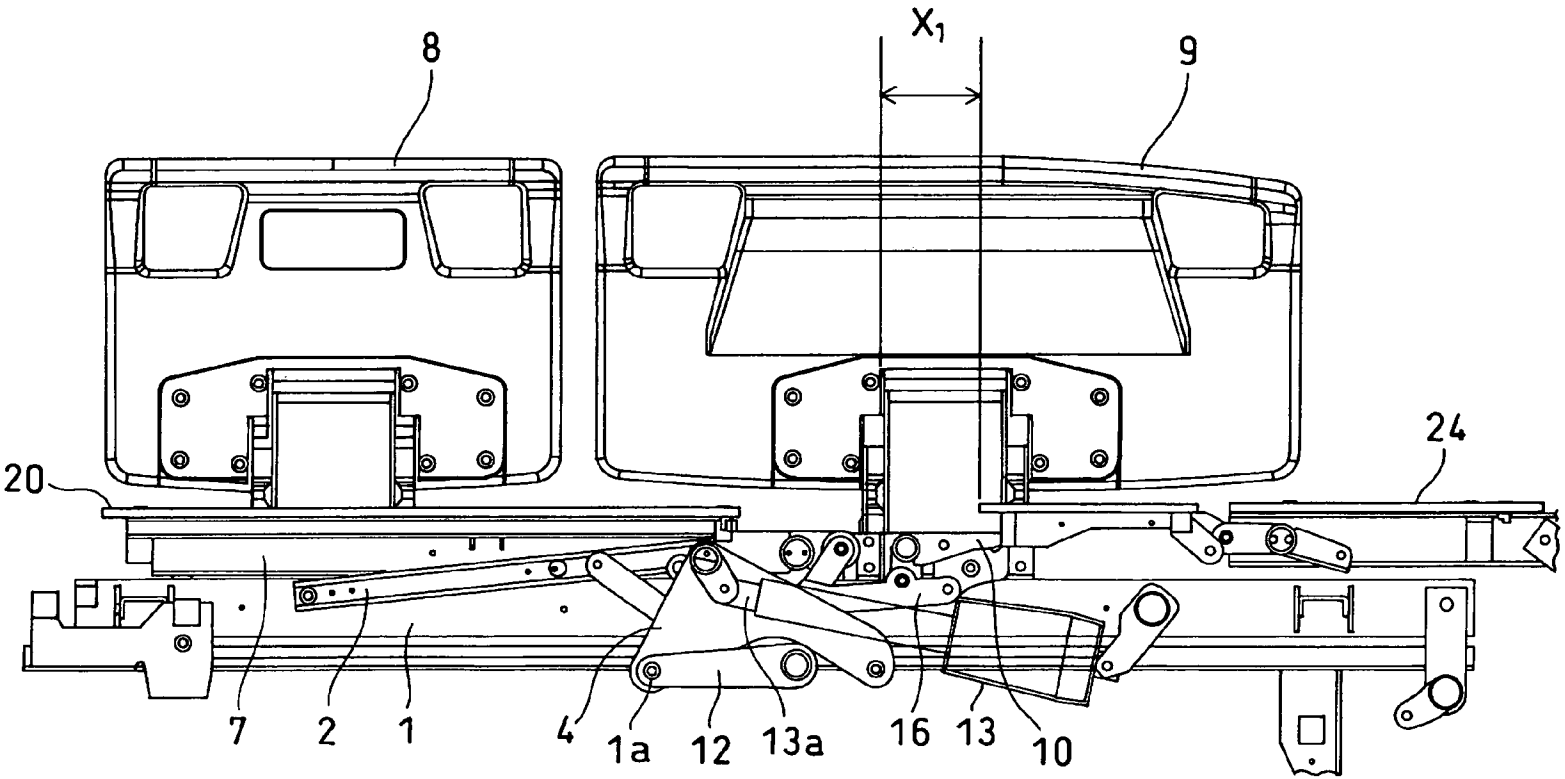
FIG. 1 is a descriptive diagram showing the initial state in the process for raising the bed.

1: Frame
2: First link
3: Second link
4: Rotator
5: Third link
6: Coupling
7: Deck
8: Back side-rail
9: Leg side-rail
10: Support part
11: Sliding part
12: Support implement
13: Actuator
**13*a***: Piston rod
14: Fourth link
15: Fifth link
16: Sixth link
17: Shaft
18: Support point
20: Back bottom
21: Rail member
22: Roller
23: Jig
24: Leg bottom

31: Longitudinal frame

32: Transverse frame

BEST MODE FOR CARRYING OUT THE INVENTION

Figure 2:
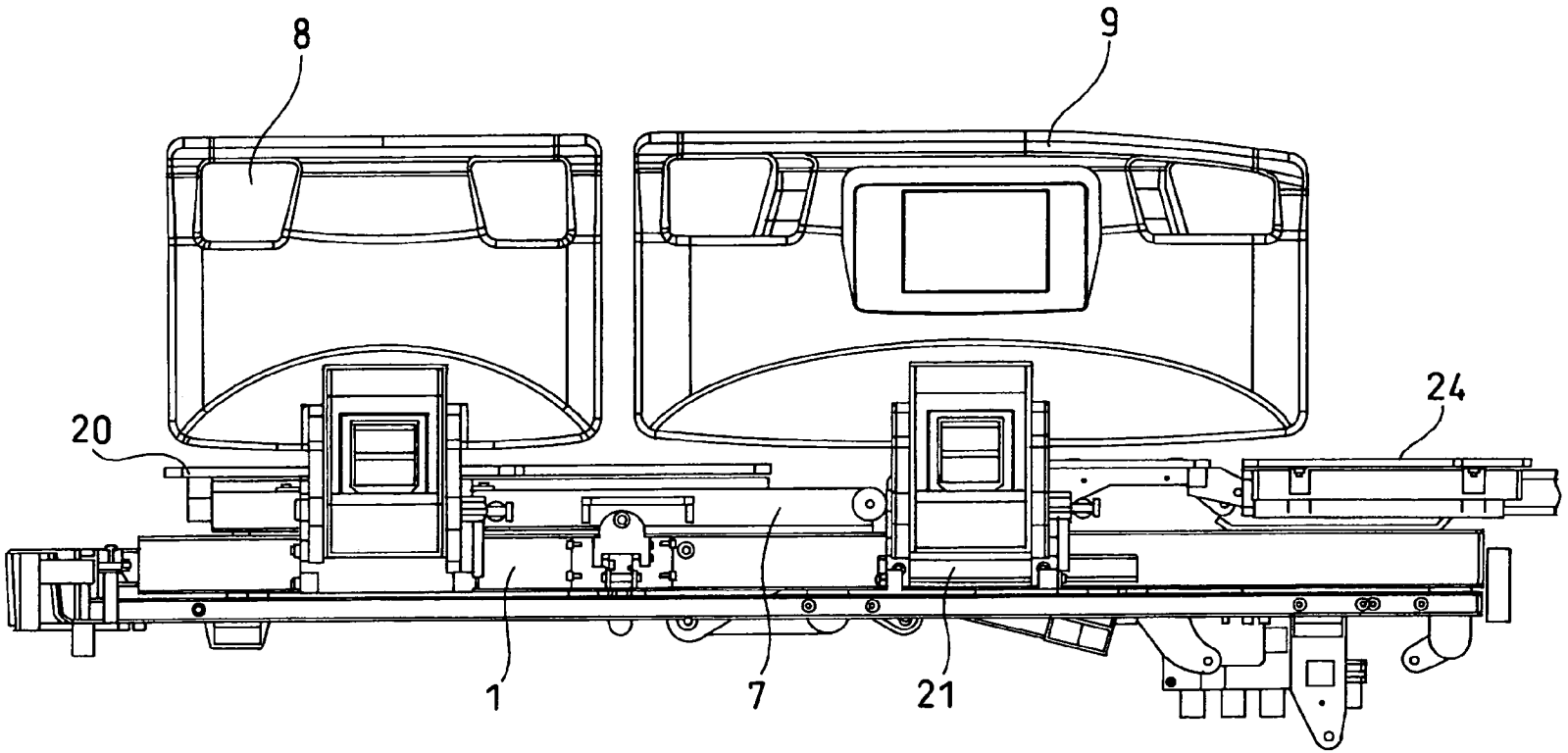
FIG. 2 is a side view corresponding to FIG. 1.
Figure 3:
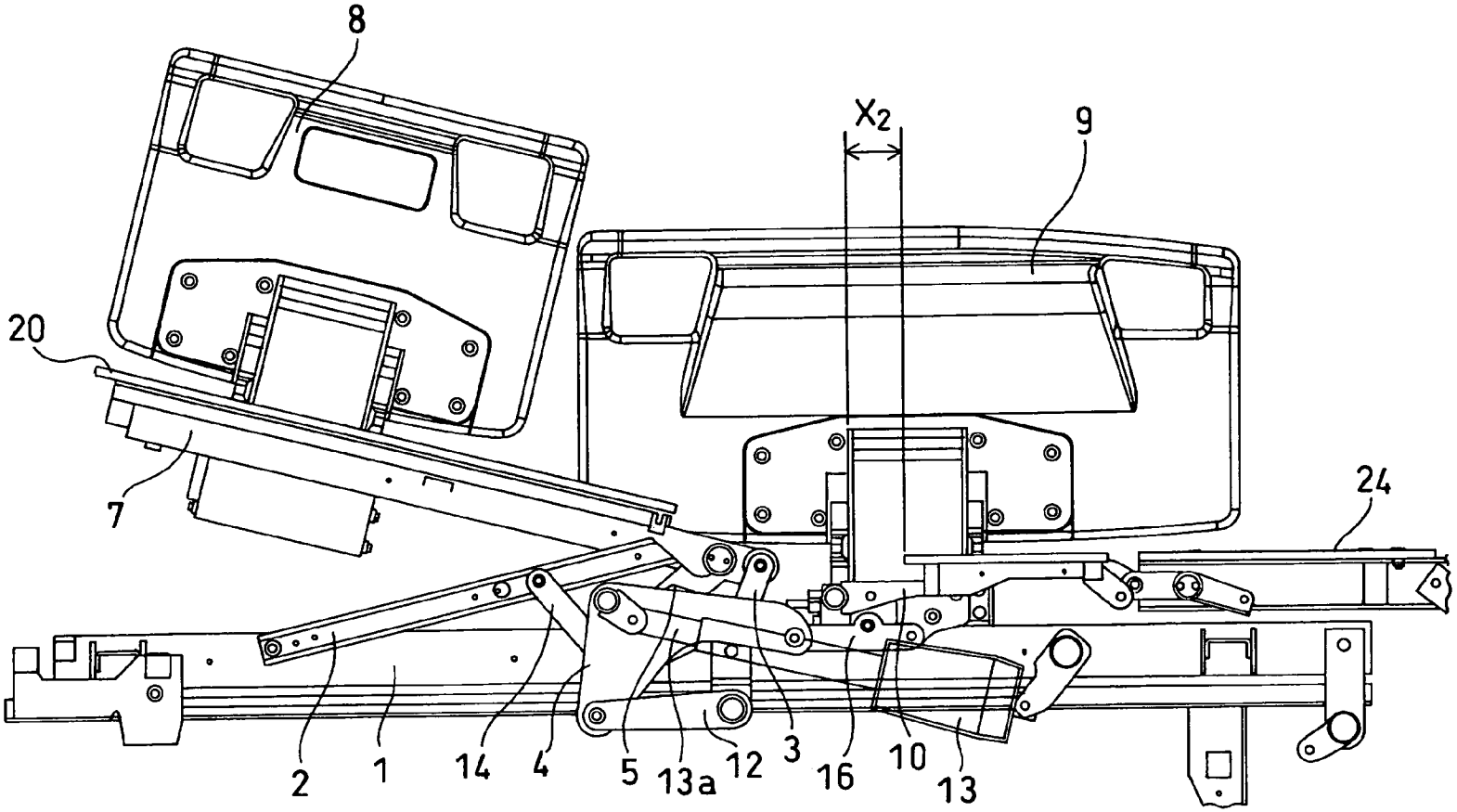
FIG. 3 is a descriptive view showing the first stage of the process for raising bed.
Figure 4:
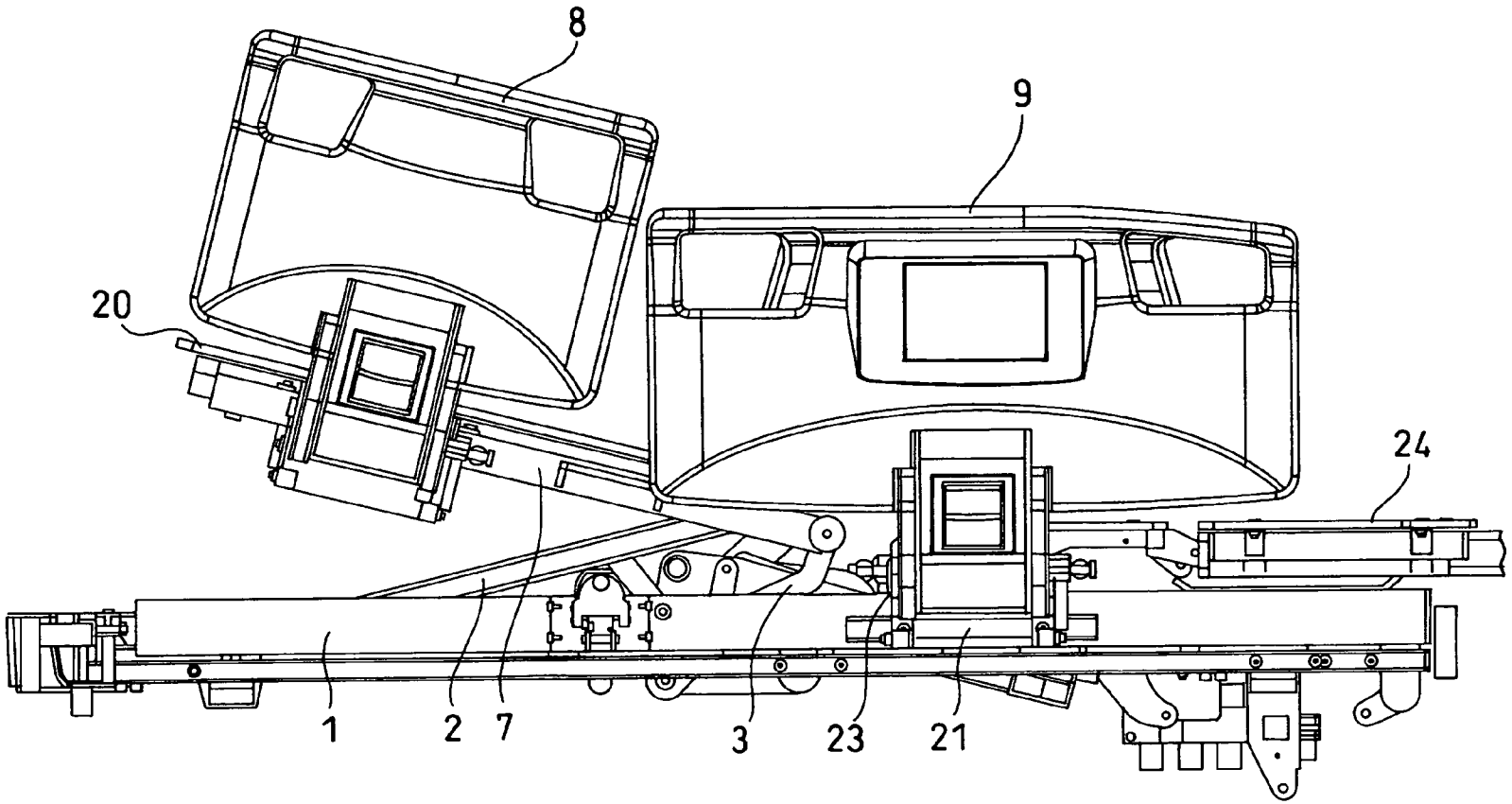
FIG. 4 is a side view corresponding to FIG. 3.
Figure 5:
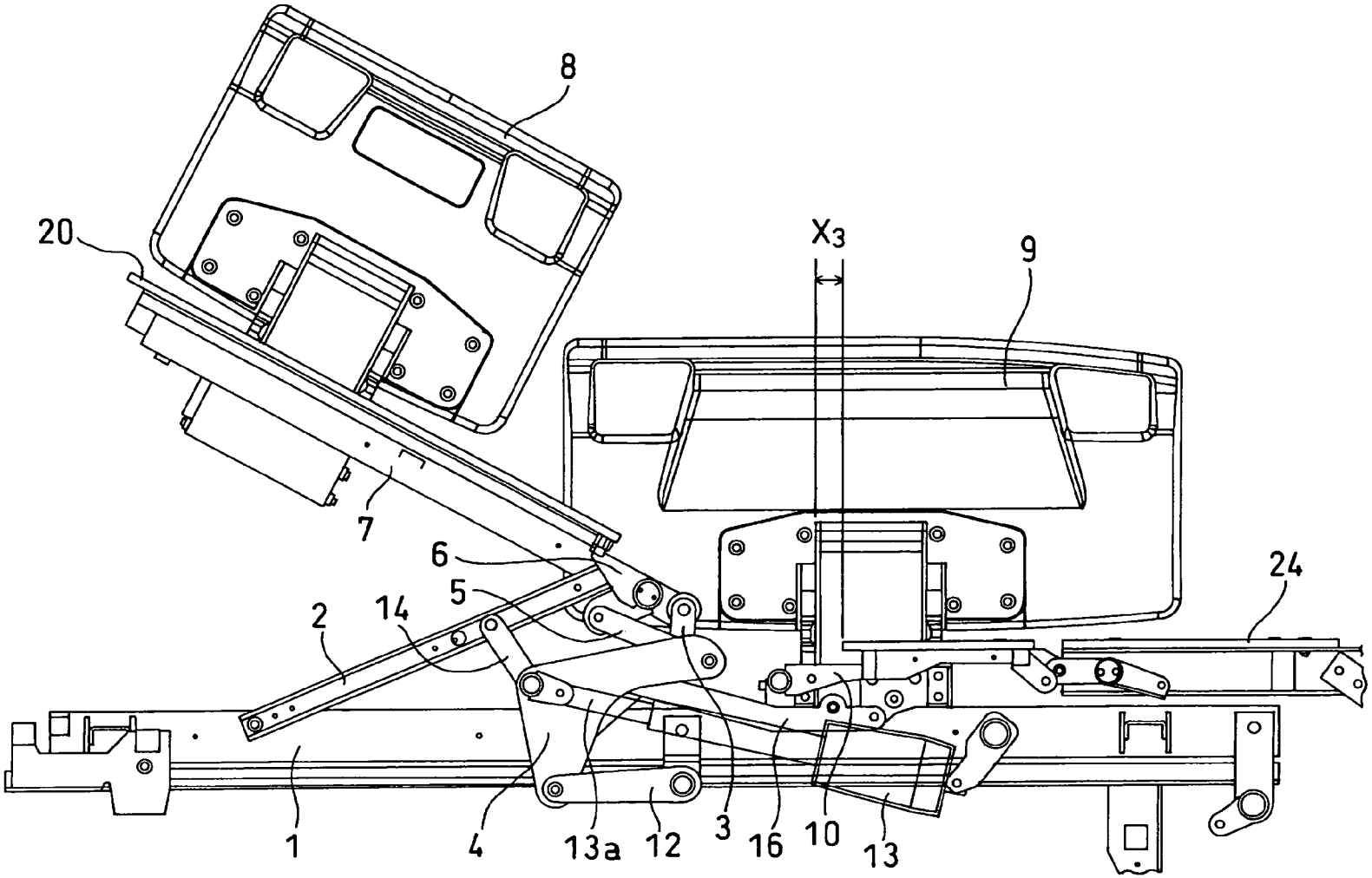
FIG. 5 is a descriptive view showing the second stage of the process for raising the bed.
Figure 6:
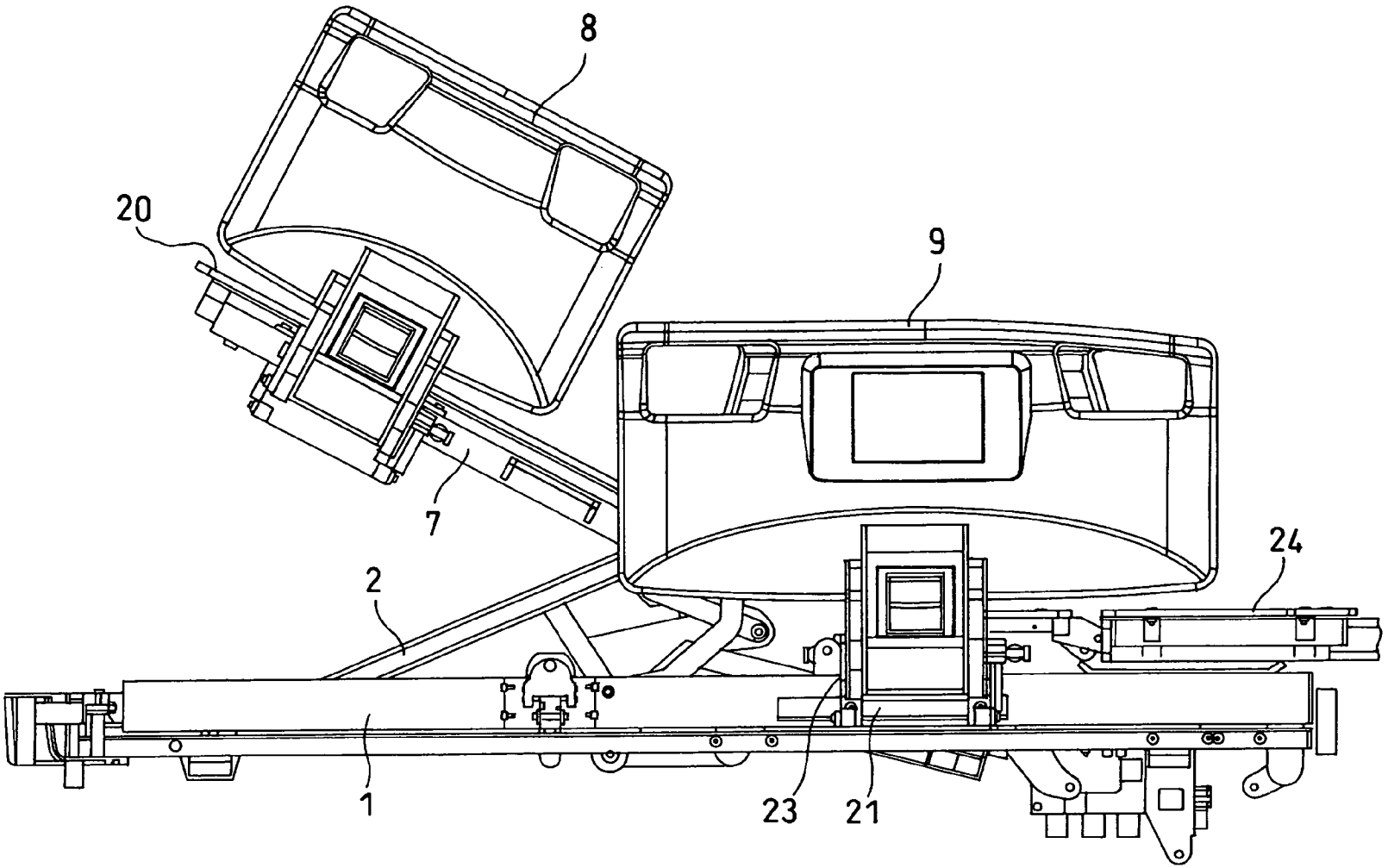
FIG. 6 is a side view corresponding to FIG. 5.
Figure 7:
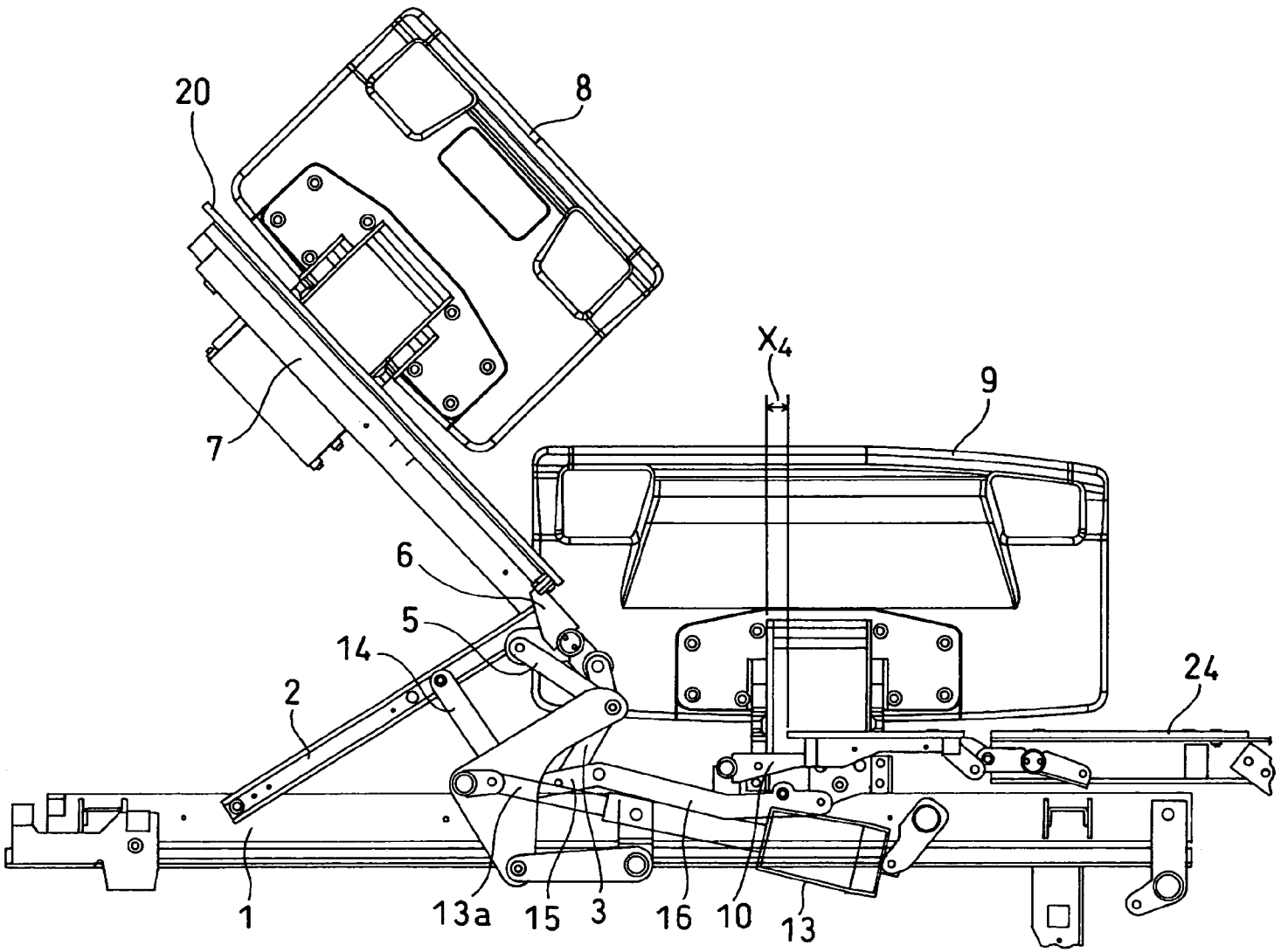
FIG. 7 is a descriptive view showing the third stage of the process for raising the bed.
Figure 8:
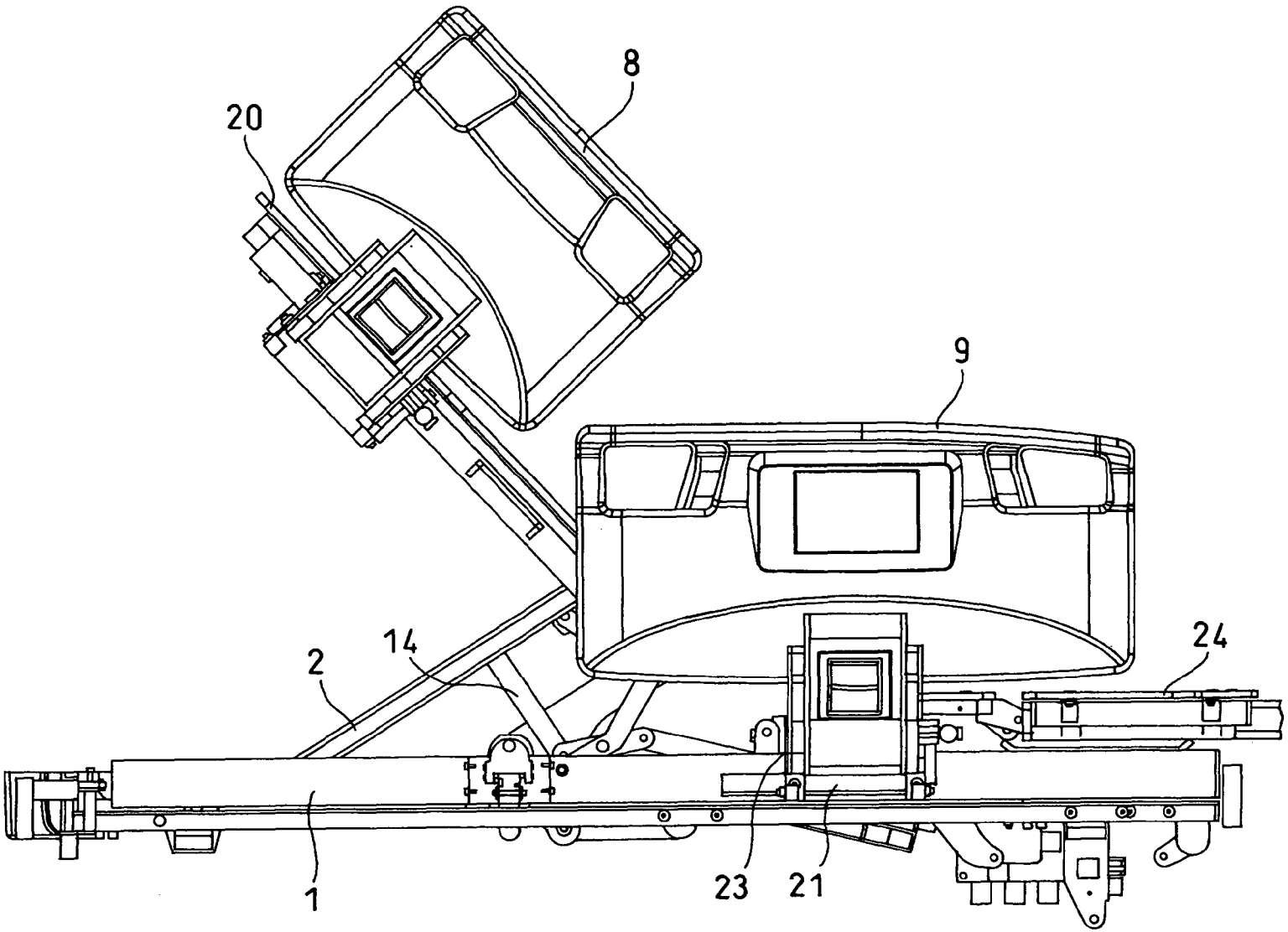
FIG. 8 is a side view corresponding to FIG. 7.
Figure 9:
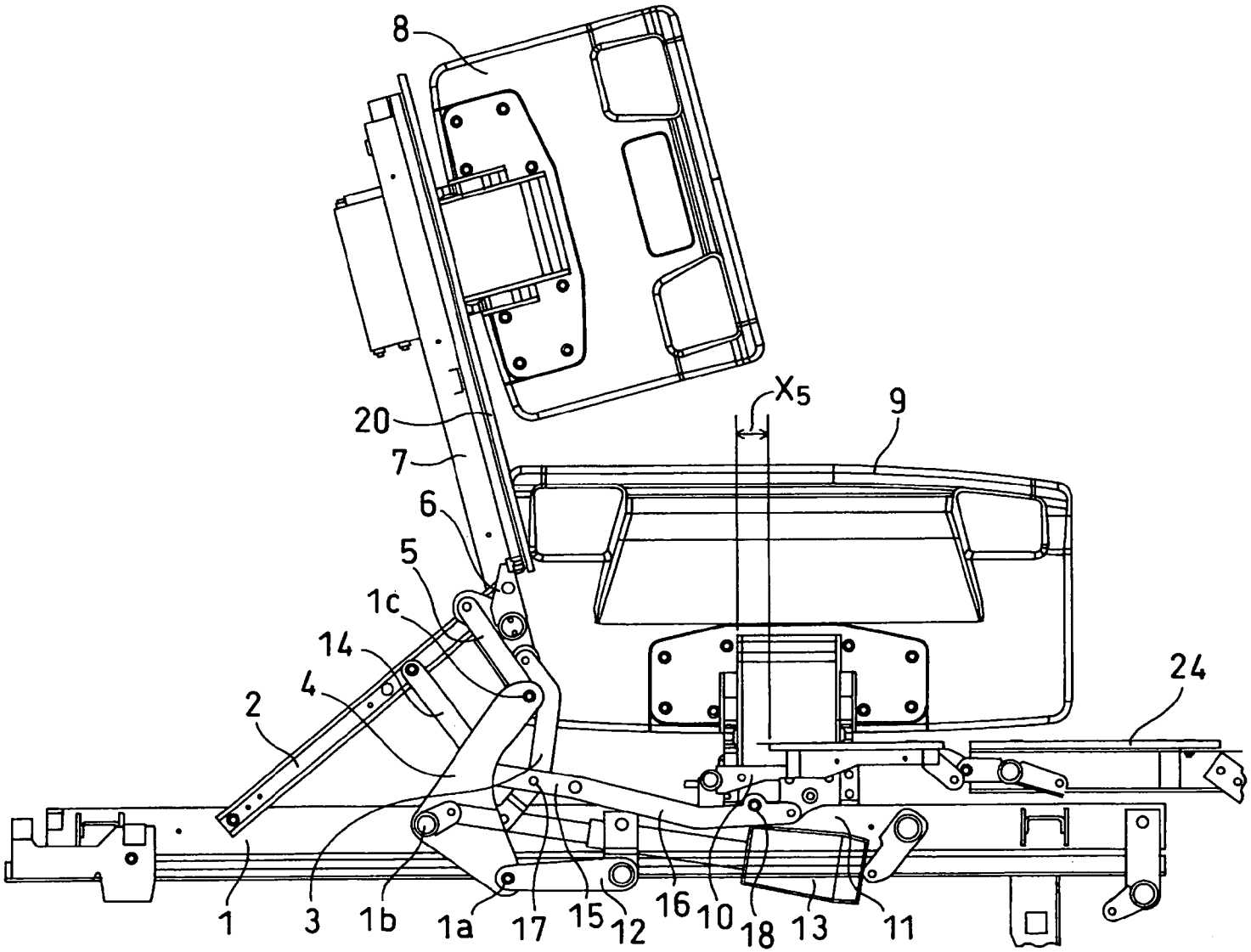
FIG. 9 is a descriptive view showing the final point in the process for raising the bed.
Figure 10:
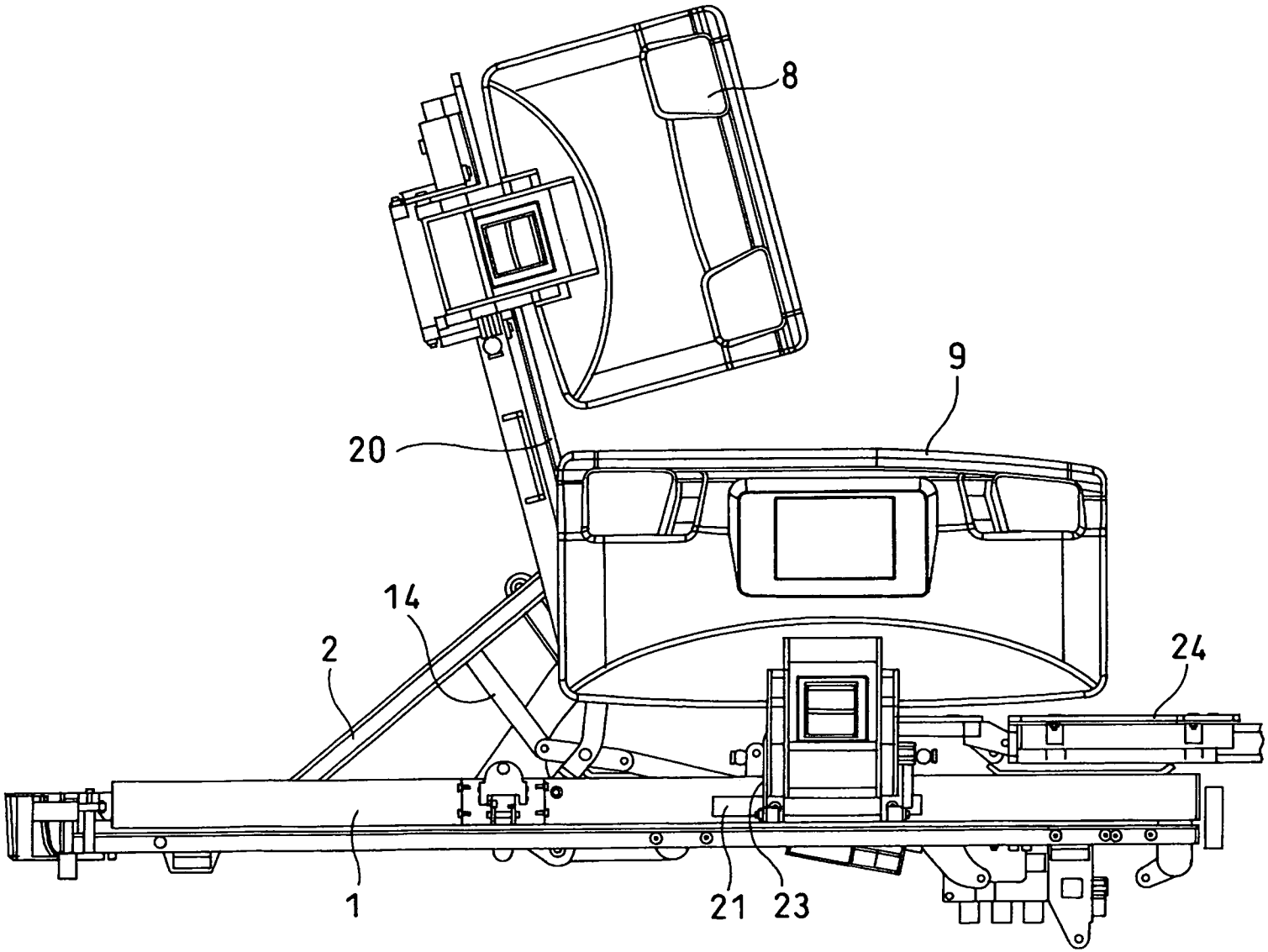
FIG. 10 is a side view corresponding to FIG. 9.
Figure 11:
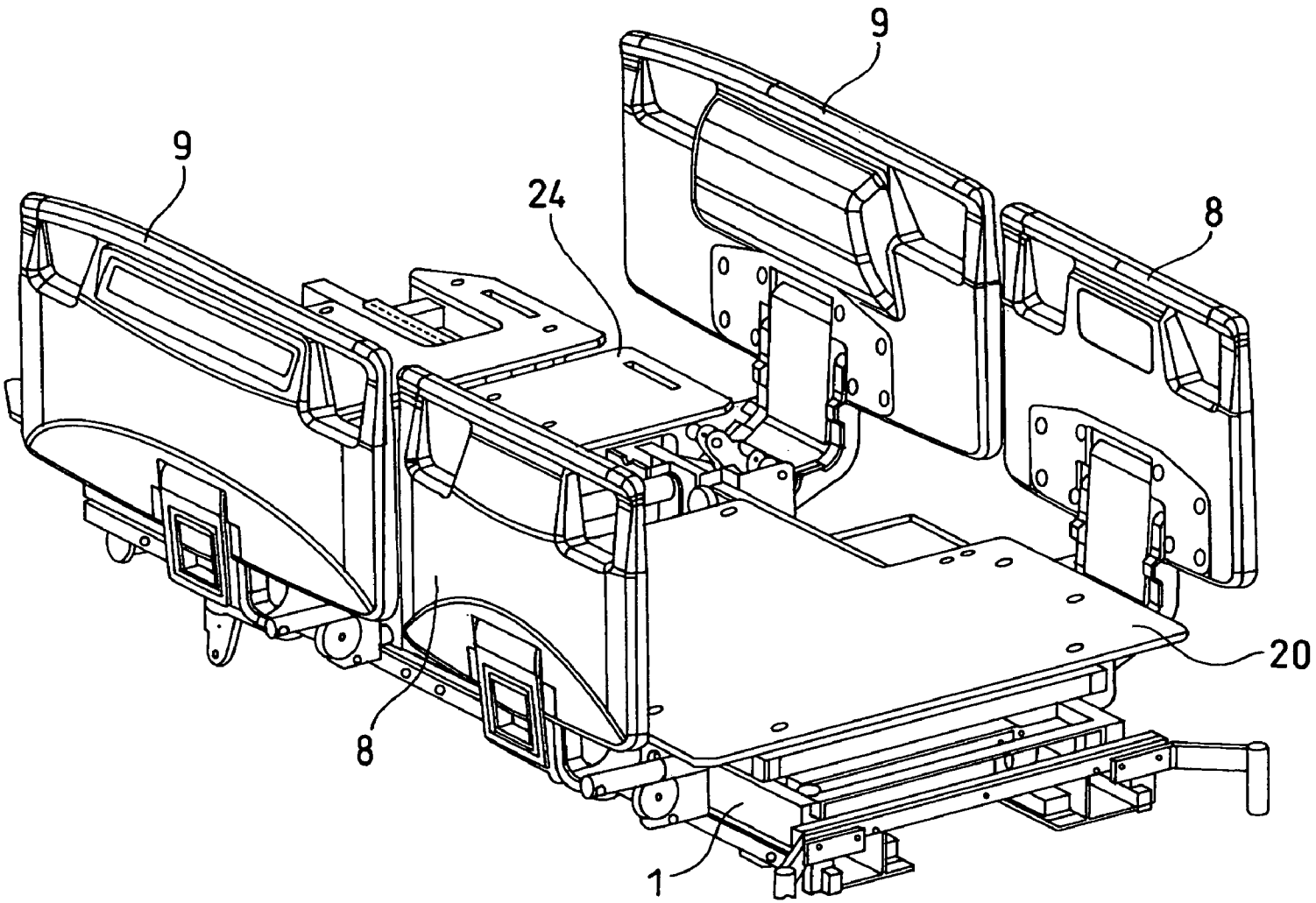
FIG. 11 is an oblique view showing the initial state of the process for raising the bed.
Figure 12:
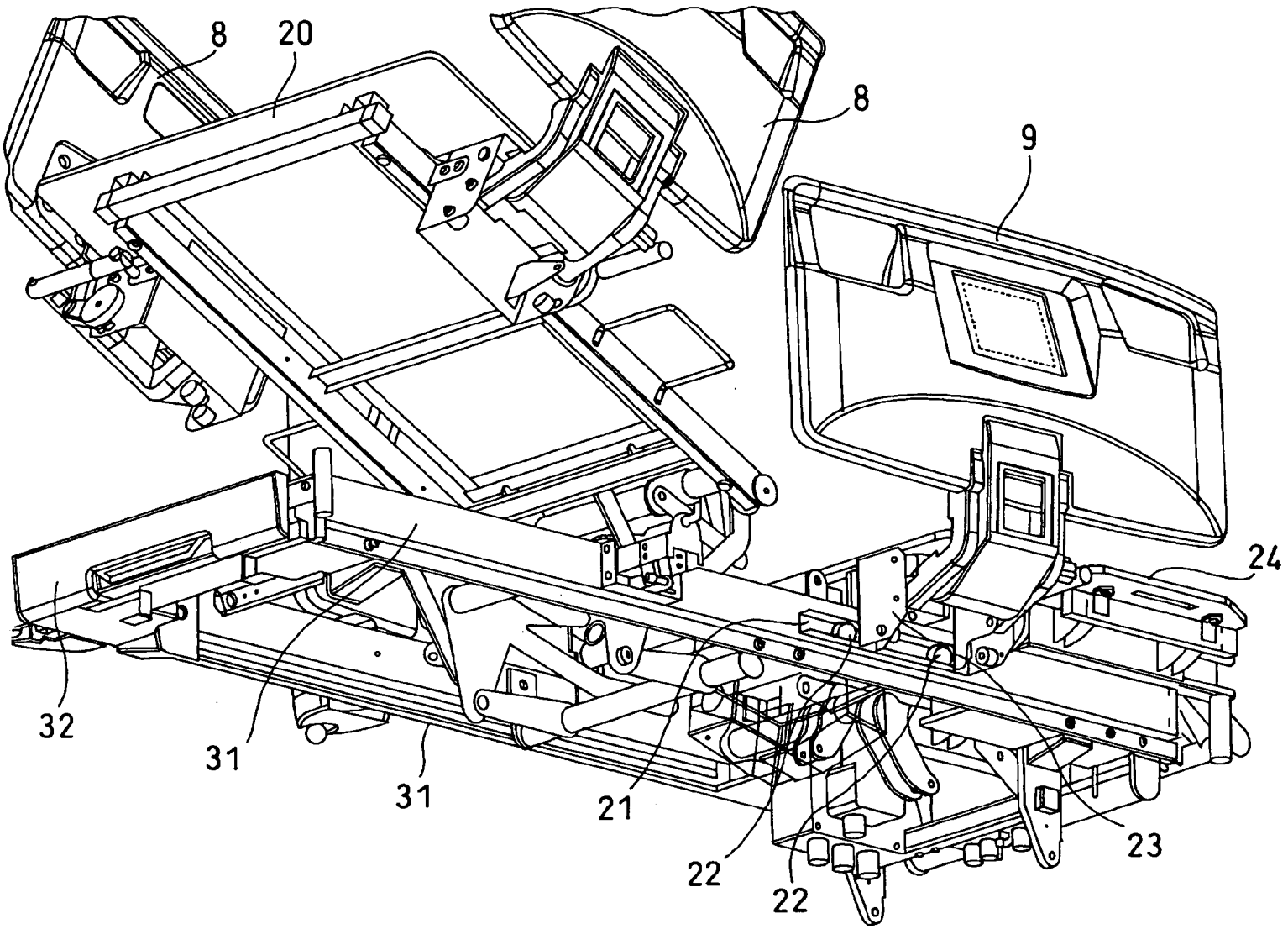
FIG. 12 is an oblique view of the bed as seen looking in the downward direction.

An embodiment of the present invention is hereafter described in detail with reference to the accompanying drawings. FIGS. 1 through 12 are descriptive views showing the chief parts of the bed equipped with side rails according to the embodiment of the present invention. FIGS. 1 through 10 are descriptive views showing the operation of raising the back bottom. FIGS. 1 and 2, FIGS. 3 and 4, FIGS. 5 and 6, FIGS. 7 and 8, and FIGS. 9 and 10 are the corresponding views. In other words, FIGS. 1 and 2 are views showing the initial state before the back bottom is raised; FIGS. 3 and 4 are views showing the first stage in raising the back bottom, wherein the back bottom has been raised only slightly; FIGS. 5 and 6 are views showing the second stage in raising the back bottom, wherein the back bottom has been raised further; FIGS. 7 and 8 are views showing the third stage in raising the back bottom, wherein the back bottom has been raised still further near the upper dead center of the tilting operation; and FIGS. 9 and 10 are views showing the final state in raising the back bottom, wherein the back bottom has been raised to the upper dead center of the tilting operation. In addition, FIG. 11 is an oblique view showing the initial state before the back bottom is raised; and FIG. 12 is an oblique view showing the sliding part of the leg side-rail as seen looking diagonally downward.

The bed equipped with side rails according to the present invention is hereafter described with reference to FIGS. 9 and 10 out of the necessity for describing the entire link mechanism for raising the back bottom and moving the leg side-rail. In FIG. 9, a first link 2 and a second link 3 are both rotatably supported at their lower ends by a horizontally positioned frame 1.

The lower end of the first link 2 is rotatably supported at a first position on the frame 1; i.e., the area at the end of the back-bottom of the frame 1. The lower end of the second link 3 is rotatably supported at a third position that is further toward the leg bottom than the abovementioned first position of the frame 1.

A coupling 6 is fixed to the base end of the deck 7 of the back bottom 20, the upper end of the first link is rotatably connected to a second position of this coupling 6, and the upper end of the second link 3 is rotatably connected to a fourth position that is further toward the leg bottom than the second position.

The lower end part la at one end of a rotator 4 is rotatably supported at an end part of a support implement 12 that is fixed to the frame 1, thereby rotatably connecting the rotator 4 to the frame 1. One end of a third link 5 is rotatably connected to an upper end part 1*c*, which is the other end of the rotator 4. The other end of the third link 5 is rotatably connected to the coupling 6.

An actuator 13 is supported by the frame 1 to allow some degree of oscillation, and the piston rod 13*a* of this actuator 13 is rotatably connected to the central part 1*b* of the rotator 4. The actuator 13 thereby rotates the rotator 4 around the end part 1*a* in a counterclockwise direction when the piston rod 13*a* advances, and the first link 2 and second link 3 exert a force in the upright direction. In addition, the actuator 13 rotates the rotator 4 around the end part 1*a* in a clockwise direction when the piston rod 13*a* retracts, and a force is exerted in the direction that returns the first link 2 and the second link 3 to their original positions.

A back side-rail 8 is fixed to the deck 7 of the back bottom 20. A leg side-rail 9 is fixed by a support part 10 that slides along the frame 1, and this support part 10 is slidably supported by a sliding part 11 on the frame 1. The leg side-rail 9 can thereby slide on the frame 1 in the longitudinal direction along the end of the leg bottom 24.

One end of a fourth link 14 is rotatably connected to the middle portion of the first link 2, and the other end of the fourth link 14 is rotatably connected to one end of a fifth link 15. In addition, the other end of the fifth link 15 is rotatably connected to one end of a sixth link 16, and the other end of the sixth link 16 is rotatably connected to the support part 10 of the leg side-rail 9 at a support point 18. Furthermore, the fifth link 15 and the second link 3 are mutually rotatably connected by a shaft 17.

In FIG. 10, a rail member 21 having a prescribed length is attached to a side surface corresponding to the leg bottom of the frame 1, and, as shown in FIG. 12, which is an oblique view as seen looking in the downward direction, a jig 23 is slidably engaged with the rail member 21 via a pair of rollers 22.

Figure 13:
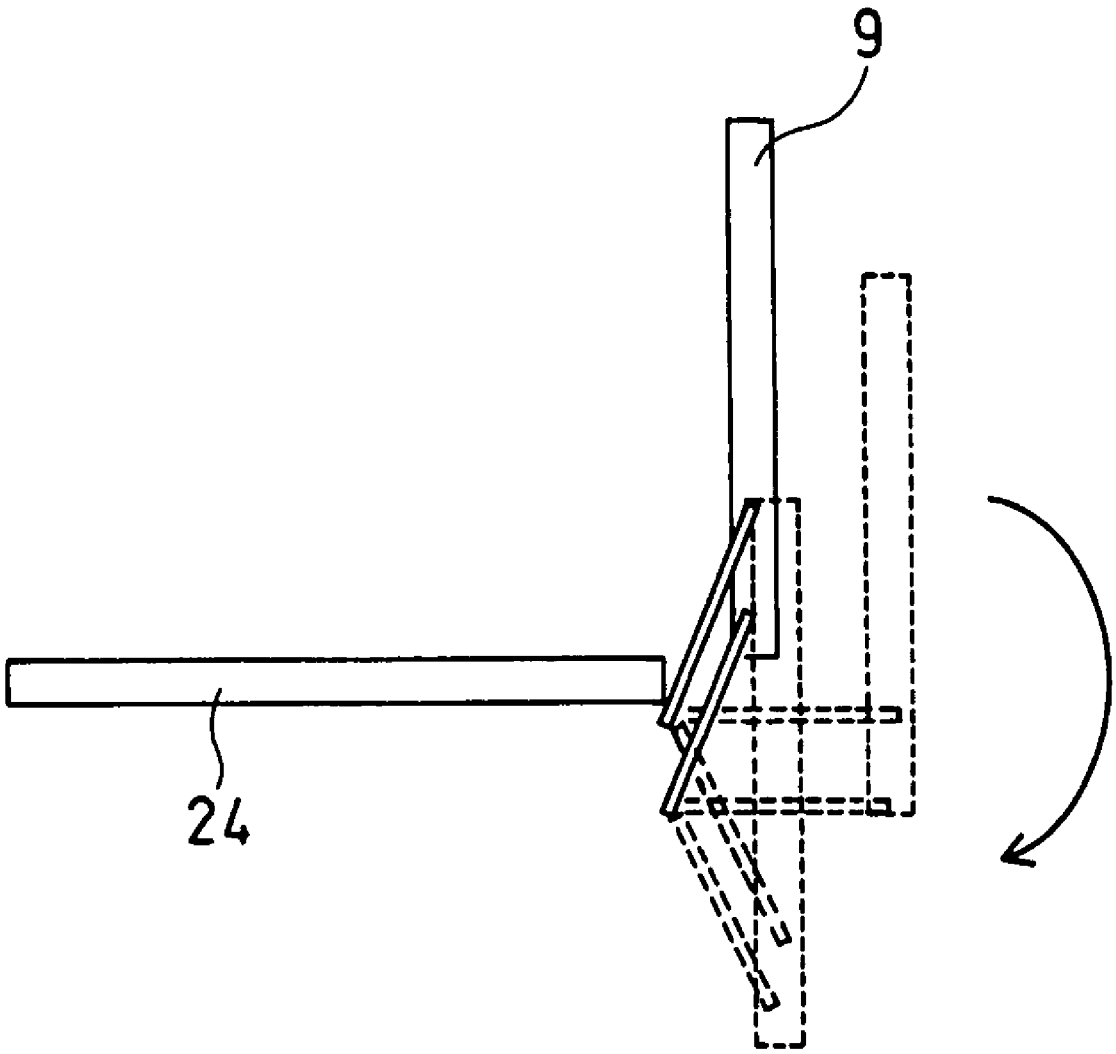
FIG. 13 is a schematic view showing the operation of a side rail.

The leg side-rail 9 is engaged with the jig 23 by the link mechanism so as to descend while kept in a perpendicular state with respect to the leg bottom 24. FIG. 13 is a schematic view showing the descending operation of the leg side-rail 9 while kept in a perpendicular state with respect to the leg bottom 24. In FIG. 13, the leg side-rail 9, which is in a perpendicular state with respect to the upper surface of the leg bottom 24, descends while temporarily sliding toward the outside of the bed and while kept in a state of being perpendicular to the leg bottom 24, and subsequently descends while sliding toward the inside of the bed, thereby changing the height position to a predetermined lower position. The above-described operation is performed in reverse when the bed is returned from the lower position to a higher position. The back side-rail 8 is also engaged by the link mechanism so as to descend and ascend while kept in a perpendicular state with respect to the back bottom 20.

In FIG. 11, a back bottom 20 and a leg bottom 24 are provided to the bed. The back side-rail 8 is fixed to both the right and left sides of the back bottom 20, and the leg side-rail 9 is engaged with both the left and right sides of the leg bottom 24 so as to be slidable along the frame 1 in the longitudinal direction of the bed. In FIG. 11, both the leg side-rail 9 and the back side-rail 8 are rectangular, and the gap therebetween is identical at the upper end and the lower end before the back is raised. The concept of a "rectangle" here includes cases that are substantially rectangular, and "identical" refers to apparent equivalence and includes cases that are substantially identical. The gap between the leg side-rail 9 and the upper end of the back side-rail 8 can be made narrower than when the corners of the side rails have an arched shape. It is thus possible to avoid the unfavorable event of having a patient having a part of his body caught between the leg side-rail 9 and the upper end of the back side-rail 8 when the bed is in a horizontal state. The leg bottom 24 is separated into a lower leg bottom and a foot bottom.

In FIG. 12, the bed frame 1 is rectangular in shape and comprises two longitudinal frames 31 and two transverse frames 32 that are connected to the longitudinal frames 31. A first link mechanism such as that described above for raising the back bottom as well as a second link mechanism connected to this first link mechanism and used to slide the leg side-rail are accommodated within this rectangle in a planar fashion. The link mechanism can thus be made more compact.

The operation of the bed equipped with side rails of the present invention configured in the manner described above is described hereunder. FIG. 1 is a descriptive view showing the initial state before the back bottom 20 is raised, and showing the side surface as seen from the inside of the frame 1. FIG. 2 is a side view seen from the outside of the frame that shows the initial state and corresponds to FIG. 1.

In FIG. 1, the piston rod 13*a* of the actuator 13 is in a retracted state, and the rotator 4 whose lower end 1*a* is rotatably supported at one end of the support implement 12, which is fixed to the frame 1, rotates in a clockwise direction until stopping at a rotation stopping position. In conjunction, the angle created by the third link 5 (see FIG. 9), which is rotatably connected at one end to the coupling 6 of the deck 7 of the back bottom 20 and which is rotatably connected at the other end to the upper end 1*c* of the rotator 4, and the first link 2, which is rotatably connected at one end to the coupling 6 and which is rotatably connected at the other end to the frame 1, becomes as large as possible; i.e., the third link 5 and the first link 2 move so as to become substantially flat, and the deck 7 of the back bottom 20 descends to a horizontal position so as to make contact with the surface of the frame 1.

In FIG. 2, the leg side-rail 9 of the leg bottom 24 is positioned without moving in the longitudinal direction of the frame 1 at the movement initiation starting point of the rail member 21, which is the left-most end within the drawing, in the initial state wherein the back bottom 20 has not been raised at all.

At this time, the distance between the specific position of the support part 10 of the leg side-rail 9 and position of the rest point to which the frame 1 is fixed is X1, as shown in FIG. 1.

The actuator 13 is then operated and the piston rod 13*a* is advanced, whereupon the back bottom 20 is raised from this initial state to the first stage of raising the back bottom, as shown in FIGS. 3 and 4. FIG. 3 is a diagram showing the side surface seen from inside the frame 1 and showing the first stage in raising the back bottom. FIG. 4 is a side view that is seen from outside the frame and that corresponds to FIG. 3.

In FIG. 3, the piston rod 13*a* of the actuator 13 advances slightly, the rotator 4 rotates only slightly in the counterclockwise direction, the first link 2 and second link 3, which are both connected to the coupling 6, each rotate slightly in a counterclockwise direction via an arm 5, most of which is hidden by the rotator 4, and the coupling 6 of the deck 7 of the back bottom 20 is thereby slightly elevated.

The first link 2 and second link 3 differ in length and are rotatably supported at different positions on the frame 1. The deck 7, one end of which being fixed to the coupling 6, therefore begins to rotate in a clockwise direction in conjunction with a counterclockwise rotation of the first link 2 and second link 3, and the back bottom 20 begins to be raised.

In this case, when the first link 2 and second link 3 begin to rotate in a counterclockwise direction, the relative positions of the fourth link 14, fifth link 15, and sixth link 16 are changed. In other words, the amount of motion of the first link 2 is greater than that of the second link 3; therefore, the fourth link 14 moves in the leftward direction of the drawing with the first link 2, the fifth link 15 is connected to the second link 3, which does not move to a great extent, and the fourth link 14 moves in the upward-left direction of the drawing. As a result, the fifth link 15 rotates slightly in a clockwise direction with the shaft 17 as a center point. The sixth link 16, which is connected to the fifth link 15, is thereby slightly pushed out toward the rightward direction of the drawing, and, as shown in FIG. 4, the support part 10 connected to the sixth link 16 moves slightly to the rightward side of the drawing via rollers 22, within the rail member 21 provided to the side surface of the frame 1.

At this time, the leg side-rail 9 moves slightly in the rightward direction of the drawing, and the distance between the specific position of the support part 10 of the leg side-rail 9 and the rest point at which the frame 1 is fixed is therefore X2, as shown in FIG. 3.

The piston rod 13*a* of the actuator 13 is advanced further to continue the operation of raising the back bottom 20, leading to the second stage in the raising of the back bottom. FIGS. 5 and 6 are descriptive views showing the second stage of the process of raising the back bottom. FIG. 5 is a diagram showing the side surface of the link mechanism seen from inside the frame 1. FIG. 6 is a side view seen from the outside of the frame and corresponds to FIG. 5.

In FIG. 5, when the piston rod 13*a* of the actuator 13 is advanced further than the first stage, the rotator 4 rotates further in a counterclockwise direction, the first link 2 and second link 3 are rotated further in a counterclockwise direction via the third link 5 past the first stage, and the coupling 6 is thereby elevated further than the first stage.

The first link 2 and second link 3 differ in length and are rotatably supported at different positions on the frame 1. Therefore, the deck 7, with one end connected to the coupling 6, is rotated in a clockwise direction further than in the first stage by the counterclockwise rotation of the first link 2 and second link 3. The angle at which the deck 7 becomes horizontal is made greater than in the first stage by the rotation of the deck 7 in a clockwise direction, and the operation of raising the back bottom 20 progresses further than in the first stage.

In this case, when the first link 2 and second link 3 begin to rotate in the counterclockwise direction, the relative positions of the fourth link 14, fifth link 15, and sixth link 16 are changed further compared to the first stage of raising the back bottom. In other words, the extent of motion of the first link 2 is greater than that of the second link 3, and, therefore, the fourth link 14 moves in the leftward direction of the drawing with the first link 2, the fifth link 15 is connected to the second link 3, which does not move to a great extent, and the fourth link 14 moves in the upward-left direction of the drawing. The fifth link 15 thus rotates in the clockwise direction with the shaft 17 as a center point. The sixth link 16, which is connected to the fifth link 15, is pushed out in the rightward direction of the drawing, and, as shown in FIG. 6, the support part 10 connected to the sixth link 16 moves further than in the first stage to the rightward side of the drawing via rollers 22 (see FIG. 12) within the rail member 21, which is provided to the side surface of the frame 1.

At this time, the distance between the specific position of the support part 10 of the leg side-rail 9 and the rest point at which the frame 1 is fixed is X3, as shown in FIG. 5.

The piston rod 13*a* of the actuator 13 is then further advanced to continue the operation of raising the back bottom 20 further, leading to the third stage in the process of raising the back bottom. FIGS. 7 and 8 are descriptive views showing the third stage of the process of raising the back bottom. FIG. 7 is a diagram showing the side surface of the link mechanism seen from inside the frame. FIG. 8 is a side view seen from the outside of the frame and corresponds to FIG. 7.

In FIG. 7, when the piston rod 13*a* of the actuator 13 is advanced further than the second stage, the rotator 4 rotates further in a counterclockwise direction, the first link 2 and second link 3 rotate further in a counterclockwise direction via the third link 5 past the second stage position, and the coupling 6 is thereby elevated further than in the second stage, and the deck 7 is rotated in a clockwise direction.

The first link 2 and second link 3 differ in length and are rotatably supported at different positions on the frame 1. Therefore, the deck 7, having one end connected to the coupling 6, is rotated in a clockwise direction further than in the second stage by the counterclockwise rotation of the first link 2 and second link 3. The angle at which the deck 7 becomes horizontal is made greater than in the second stage by the rotation of the deck 7 in a clockwise direction, and the process of raising the back bottom 20 progresses further than in the second stage.

In this case, when the first link 2 and second link 3 begin to rotate in a counterclockwise direction, the relative positions of the fourth link 14, fifth link 15, and sixth link 16 are changed further than in the second stage of raising the back bottom. In other words, the extent of motion of the first link 2 is greater than that of the second link 3, and, therefore, the fourth link 14 moves with the first link 2 in the leftward direction of the drawing, the fifth link 15 is connected to the second link 3, which does not move to a great extent, and the fourth link 14 moves in the upward-left direction of the drawing. The fifth link 15 thus rotates in a clockwise direction with the shaft 17 as a center point. The sixth link 16, which is connected to the fifth link 15, is pushed out in the rightward direction of the drawing, and, as shown in FIG. 8, the support part 10 of the leg side-rail 9, which is connected to the sixth link 16, moves further than in the second stage to the rightward side of the drawing, via rollers 22 (see FIG. 12) within the rail member 21, which is provided to the side surface of the frame 1.

At this time, the distance between the specific position of the support part 10 of the leg side-rail 9 and the rest point at which the frame 1 is fixed is X4, as shown in FIG. 7. The distance between the specific position of the support part 10 of the leg side-rail 9 and the rest point at which the frame 1 is fixed becomes successively smaller from X1 of FIG. 1 (initial state), X2 of FIG. 3 (first stage), X3 of FIG. 5 (second stage), to X4 of FIG. 7 (third stage) according to the movement in the rightward direction of the leg side-rail 9. It is thereby apparent that the leg side-rail 9 moves progressively toward the rightward direction of the drawings.

The leg side-rail 9 moves in the rightward direction when the back side-rail 8 rotates in the clockwise direction together with the tilting of the deck 7. This prevents contact between the back side-rail 8 and the leg side-rail 9, and prevents the rotational movement of the back side-rail 8 from being impeded.

FIGS. 9 and 10 are descriptive views, each showing when the process of raising the back bottom has concluded. FIG. 9 is a diagram showing the side surface of the link mechanism seen from inside the frame. FIG. 10 is a side view seen from the outside of the frame and corresponds to FIG. 9.

In FIG. 9, when the deck 7 tilts in a clockwise direction and the tilting angle increases, the fifth link 15 and the sixth link 16 form a substantially straight relationship, the amount the sixth link 16 is extended in the rightward direction by the rotational movement of the fifth link 15 is reduced, and the second link 3 continues to turn in a counterclockwise direction. Therefore, the variance between the amount that the shaft 17 moves in the leftward direction and the amount that the sixth link 16 is pushed in the rightward direction by the turning of the fifth link 15 is reversed. This reversal causes the amount by which the sixth link 16 is pulled in the leftward direction by the leftward movement of the shaft 17 to exceed the amount that the sixth link 16 is pushed in the rightward direction by the fifth link 15, and the leg side-rail 9 supported by the support part 10 is pulled back in the leftward direction of the drawing. For this reason, X5 of FIG. 9 is made larger than X4 of FIG. 7.

In other words, in the bed according to the present embodiment, when the deck 7 is elevated and the back side-rail 8 turns in a clockwise direction, the leg side-rail 9 temporarily moves in the rightward direction following the rotating of the back side-rail 8, the two elements are prevented from colliding, and, when the back side-rail 8 has reached an adequate height, the leg side-rail 9 is returned in the leftward direction of the drawing so as not to excessively increase the gap between the leg side-rail 9 and the back side-rail 8. The gap between the back side-rail 8 and the leg side-rail is thereby adjusted so as not to be excessively wide.

According to the present embodiment, the leg side-rail 9 is moved in the direction away from the back side-rail, which is the longitudinal direction of the frame 1, in conjunction with the raising of the back bottom by the second link mechanism, which raises the back bottom 20 and which is connected to the first link mechanism; and, subsequently, the gap between the back side-rail and the leg side-rail is prevented from becoming excessively wide by slightly returning the leg side-rail toward the back side-rail before the operation of raising the back bottom has concluded. It is thus possible to prevent part of the body of a patient from being caught between the back side-rail and leg side-rail.

In addition, according to the present embodiment, the leg side-rail is the only side rail that slides in conjunction with the raising of the back bottom, thus enabling the back side-rail to be employed as a securing member for cords during medication or evaluations of the physical condition of the patient.

Furthermore, according to the present embodiment, the back side-rail 8, which is close to the head of the patient, is secured in place, thereby eliminating any discomfort on the part of the patient caused by movement of the member in the area around the head, and removing any associated hazards. In addition, the patient can safely place their hand on the back side-rail 8 for support because the back side-rail is fixed and does not move.

According to the present embodiment, the leg side-rail 9 slides on the fixed-type bed frame 1. The side rail of the present embodiment has higher mechanical strength and rigidity than does the prior art rail in which a back side-rail is further slidably provided to a rotatable back bottom 20.

According to the present embodiment, the gap between the back side-rail 8 and the leg side-rail 9 while the back bottom 20 is being raised can satisfy, for example, the IEC 60601-2-38 standard (60 mm or less, or 235 mm or greater).

In the embodiment described above, the process of raising the back bottom was described in terms of a first stage, second stage, and third stage for the sake of convenience, but such steps are not distinctly present in the action of raising the back bottom.

INDUSTRIAL APPLICABILITY

The present invention is a bed equipped with side rails that, even when the back bottom is raised, causes no discomfort to the patient, does not impede the securing of tubes or cords used for treatment, and, by having the gap between the back side-rail and the leg side-rail kept consistently at a fixed distance, prevents the risk of the extremities of the patient being caught and the patient from falling. The present invention is thus useful in a variety of medical facilities, especially nursing-care facilities and the like.

What is claimed is:

1. A bed equipped with side rails comprising:

a bed frame;

a back bottom;

a leg bottom;

a first link mechanism, having a lower end rotatably connected to the bed frame, for tilting said back bottom with respect to said bed frame;

a back side-rail fixed to said back bottom;

a leg side-rail that is provided to said leg bottom and being spaced from said back side-rail while being allowed to move in the longitudinal direction of the bed; and a second link mechanism, having a lower end rotatably connected to the bed frame, that is connected to said first link mechanism and that moves said leg side-rail in conjunction with the tilting motion of said back bottom;

wherein said leg side-rail is moved toward the leg end of said bed by said second link mechanism while said back bottom is raised by said first link mechanism to reduce the gap between said back side-rail and said leg side-rail.

2. The bed equipped with side rails according to claim 1, wherein said leg side-rail and said back side-rail are rectangularly shaped; and the gap between the rails is equal at the top end and the bottom end of each rail before the back is raised.

3. The bed equipped with side rails according to claim 1, further comprising:

a coupling that rotatably connects the first link mechanism to the second link mechanism.

4. The bed equipped with side rails according to claim 1, further comprising:

a rotator connected to the first link mechanism and the second link mechanism; and an actuator connected to the rotator, wherein the actuator rotates the rotator to cause the first link mechanism and the second link mechanism to exert a force.

5. The bed equipped with side rails according to claim 1, wherein the leg side-rail is slidably connected to the bed frame by a slidable support member.

6. The bed equipped with side rails according to claim 1, wherein said first link mechanism comprises:

a first link having one end rotatably connected to a first position of said bed frame and another end rotatably connected to a second position on said back bottom; and a second link, which is shorter than said first link, having one end rotatably connected to a third position that is further toward said leg bottom than said first position of said bed frame, and another end rotatably connected to a fourth position that is further toward said leg bottom than said second position of said back bottom.

7. The bed equipped with side rails according to claim 6, wherein the first link mechanism further comprises:

a rotator having one end rotatably connected to said bed frame; and a third link rotatably connected between another end of said rotator and said first link, said second link, or said back bottom.

8. The bed equipped with side rails according to claim 7, wherein the first link mechanism further comprises an actuator for turning said rotator in one direction to exert force via said third link on said first link and said second link in a rising direction, and turning said rotator in an opposite direction to exert force via said third link on said first link and said second link in a returning direction.

9. The bed equipped with side rails according to claim 8, wherein said second link mechanism comprises:

a fourth link having one end rotatably connected to the first link of said first link mechanism;

a fifth link rotatably connected to said second link; and a sixth link having one end rotatably connected to said leg side-rail.

10. The bed equipped with side rails according to claim 9, wherein one end of said fifth link is rotatably connected to another end of said fourth link, and another end of said fifth link is rotatably connected to the other end of said sixth link.

11. A bed equipped with side rails comprising:

a bed frame;

a back bottom;

a leg bottom;

a first link mechanism for tilting said back bottom with respect to said bed frame;

a back side-rail fixed to said back bottom;

a leg side-rail that is provided to said leg bottom while being allowed to move in the longitudinal direction of the bed; and a second link mechanism that is connected to said first link mechanism and that moves said leg side-rail in conjunction with the tilting motion of said back bottom; wherein said leg side-rail is moved toward the leg end of said bed by said second link mechanism while said back bottom is raised by said first link mechanism, wherein said first link mechanism comprises:

a first link having one end rotatably connected to a first position of said bed frame and another end rotatably connected to a second position on said back bottom;

a second link, which is shorter than said first link, having one end rotatably connected to a third position that is further toward said leg bottom than said first position of said bed frame, and another end rotatably connected to a fourth position that is further toward said leg bottom than said second position of said back bottom;

a rotator having one end rotatably connected to said bed frame;

a third link rotatably connected between another end of said rotator and said first link, said second link, or said back bottom; and an actuator for turning said rotator in one direction to exert force via said third link on said first link and said second link in a the rising direction, and turning said rotator in an opposite direction to exert force via said third link on said first link and said second link in a returning direction.

12. The bed equipped with side rails according to claim 11, wherein said second link mechanism comprises:

a fourth link having one end rotatably connected to the first link of said first link mechanism;

a fifth link rotatably connected to said second link; and a sixth link having one end rotatably connected to said leg side-rail; wherein one end of said fifth link is rotatably connected to another end of said fourth link, and another end of said fifth link is rotatably connected to the other end of said sixth link.

13. The bed equipped with side rails according to claim 12, wherein said first link mechanism and said second link mechanism are held within said bed frame as viewed in a plane.

14. The bed equipped with side rails according to claim 11, wherein said leg side-rail and said back side-rail are rectangularly shaped; and the gap between the rails is equal at the top end and the bottom end of each rail before the back is raised.

15. The bed equipped with side rails according to claim 12, wherein said leg side-rail and said back side-rail are rectangularly shaped; and the gap between the rails is equal at the top end and the bottom end of each rail before the back is raised.

16. The bed equipped with side rails according to claim 13, wherein said leg side-rail and said back side-rail are rectangularly shaped; and the gap between the rails is equal at the top end and the bottom end of each rail before the back is raised.

* * * * *